US005115716A

United States Patent [19]

Doering et al.

[11] Patent Number: 5,115,716

[45] Date of Patent: May 26, 1992

[54] AUTOMATIC PERCUSSION PRIMER FEED MECHANISM

[75] Inventors: Timothy J. Doering, Anoka; David R. Zappa, Mahtomedi, both of Minn.

[73] Assignee: FMC Corporation, Chicago, Ill.

[21] Appl. No.: 471,327

[22] Filed: Jan. 29, 1990

[51] Int. Cl.[5] ..... F41A 3/08

[52] U.S. Cl. ..... 89/25; 89/27.13; 89/33.02; 89/28.05; 89/20.2

[58] Field of Search ..... 89/19, 20.2, 20.4, 21, 89/24, 25, 33.02, 23, 17, 27.13, 28.05

[56] References Cited

U.S. PATENT DOCUMENTS

| | | | |
|---|---|---|---|
| 378,828 | 2/1888 | Driggs et al. | 89/23 |
| 1,091,638 | 3/1914 | Dawson et al. | 89/27.13 |
| 1,336,093 | 4/1920 | Schneider | 89/19 |
| 3,044,364 | 7/1962 | Reepmeyer | 89/20.2 |
| 3,099,937 | 8/1963 | Bartels | 89/24 |
| 3,951,041 | 4/1976 | Bartolles | 89/24 |
| 4,991,490 | 2/1991 | Balbo et al. | 89/24 |

FOREIGN PATENT DOCUMENTS

| | | | |
|---|---|---|---|
| 24997 | 3/1981 | European Pat. Off. | 89/24 |
| 372984 | 5/1932 | United Kingdom . | |
| 415916 | 9/1934 | United Kingdom . | |
| 885361 | 12/1961 | United Kingdom | 89/24 |
| 1297201 | 11/1972 | United Kingdom | 89/27.13 |

*Primary Examiner*—Stephen Johnson

*Attorney, Agent, or Firm*—J. Preston Oxenham; Richard B. Megley

[57] ABSTRACT

A primer feed mechanism for automatically feeding unfired primers to, and extracting fired primers from, an artillery piece. A magazine having a rotatable cylindrical drum carrying a plurality of primer cartridges is detachably mounted adjacent the breach block of an artillery piece. A user actuable release handle controls movement of a reciprocable mounted camplate. Movement of the camplate in one direction indexes the rotatable drum to align a fresh primer cartridge with the firing chamber of the artillery piece. Such movement of the camplate also drives a rearwardly positioned bolt toward the breach block of the artillery piece thereby driving the unfired primer cartridge into the firing chamber. Movement of the camplate in the opposite direction causes the bolt to extract the fired primer cartridge from the firing chamber and back into the magazine drum.

7 Claims, 9 Drawing Sheets

AUTOMATIC PERCUSSION PRIMER FEED MECHANISM

BACKGROUND OF THE INVENTION

This invention relates generally to artillery systems and, more particularly to a system for automatically feeding percussion primers in an artillery piece.

Present field artillery pieces operate by detonating a powder charge behind a projectile in a gun barrel. Typically the powder charge is detonated by means of a primer cartridge that, in turn, is detonated under the force of an externally applied blow. A fresh (unfired) primer cartridge must be used for each firing of the artillery piece.

Known field artillery systems require that the primer cartridges be inserted manually into the firing chamber prior to each shot of the artillery piece. This is a time consuming and tedious operation, compounded by the fact that the person performing the task is sometimes forced by temperature conditions to wear hand protection. Furthermore, the spent primer cartridges are typically discarded onto the operating floor of the artillery piece. This can create a hazard to the gun crew, especially when the piece is being fired as rapidly as possible.

In view of the foregoing, it is a general object of the present invention to provide a new and improved system for feeding primer cartridges in an artillery piece.

It is a further object of the present invention to provide a new and improved system for feeding primer cartridges in an artillery piece wherein the primer cartridges are automatically fed with a minimum of handling by operating personnel.

It is a still further object of the present invention to provide a new and improved system for feeding primer cartridges in an artillery piece wherein spent primer cartridges are contained for convenient disposal without undue clutter on the weapon operating floor.

It is a still further object of the present invention to provide a new and improved system for feeding primer cartridges in an artillery piece that is reliable and able to withstand the repeated recoil of the artillery piece as it is fired over and over.

SUMMARY OF THE INVENTION

The invention provides a primer feed mechanism including a magazine for containing a plurality of primer cartridges and further including a mounting assembly for mounting the magazine to the breech end of an artillery piece. An actuator, responsive to an operator input, is provided for individually feeding unfired primers from the magazine to the artillery piece and for returning fired primers from the artillery piece to the magazine.

BRIEF DESCRIPTION OF THE DRAWING

The features of the present invention which are believed to be novel are set forth with particularity in the appended claims. The invention, together with the further objects and advantages thereof, may best be understood by reference to the following description taken in conjunction with the accompanying drawings. Wherein like reference numerals identify like elements, and wherein:

DESCRIPTION OF THE PREFERRED EMBODIMENT

Figure 1:
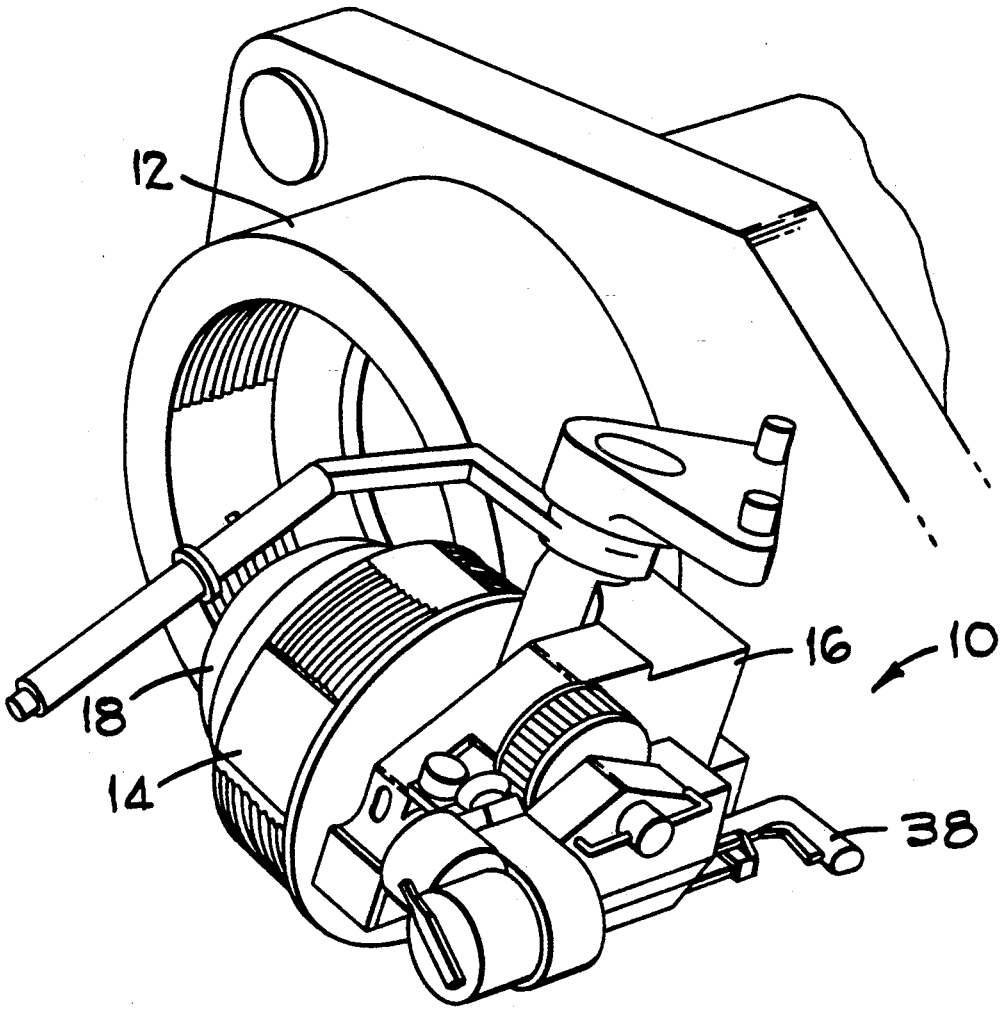
FIG. 1 is fragmentary perspective view of the breech end of an artillery piece fitted with an automatic primer feed mechanism constructed in accordance with one aspect of the invention.
Figure 2:
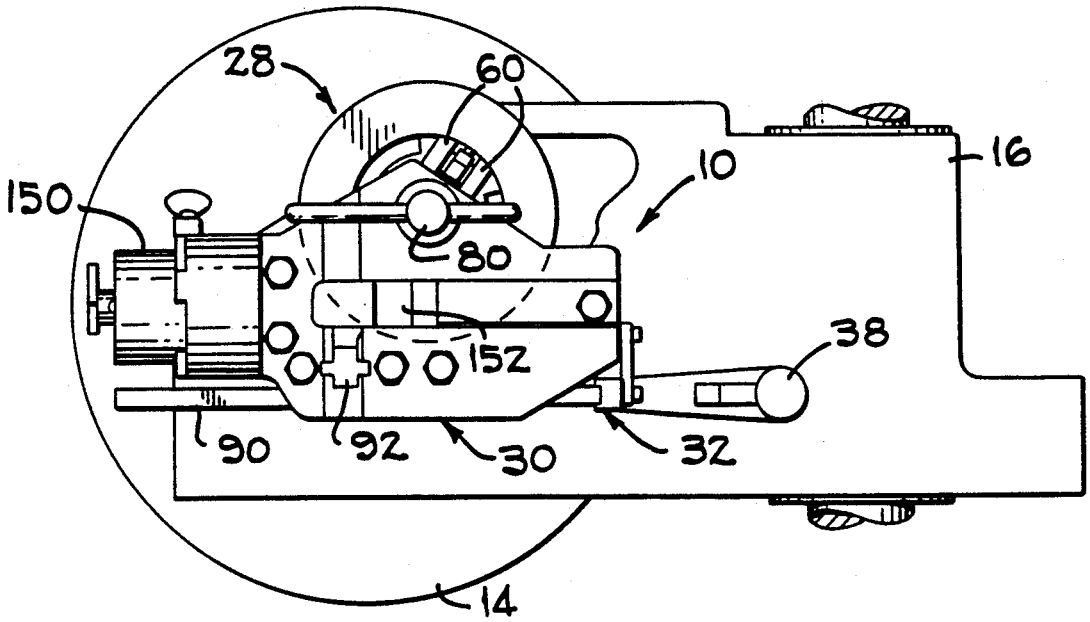
FIG. 2 is a front elevational view of the automatic primer feed mechanism mounted adjacent the breech block of the artillery piece.
Figure 3:
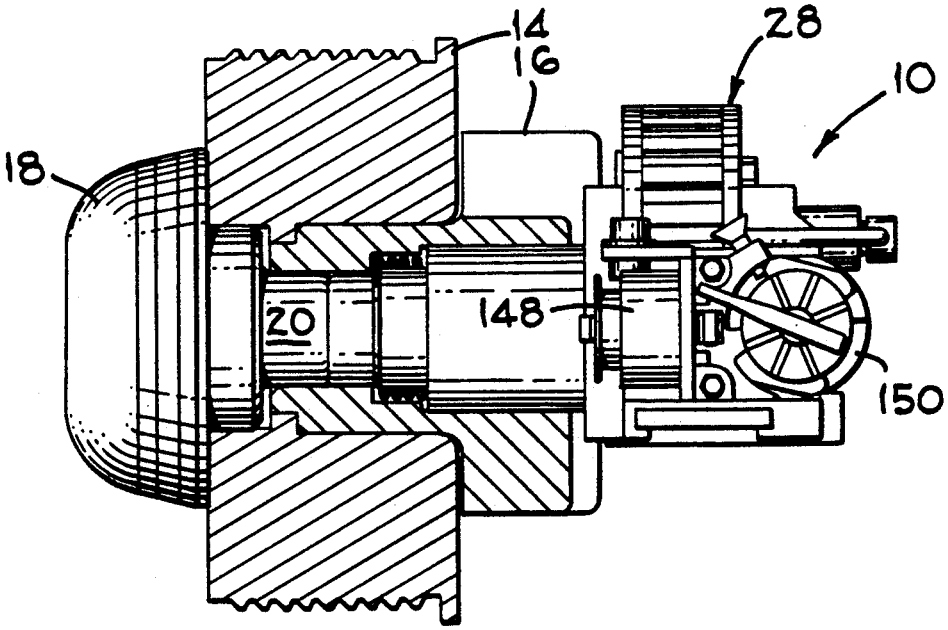
FIG. 3 is a side elevational view, partially in section, of the automatic primer feed mechanism mounted adjacent the breech block of the artillery piece.

Referring to the drawings, and, in particular, to FIGS. 1–4, an automatic primer feed mechanism 10 embodying various features of the invention is shown mounted adjacent the breech end of an artillery piece 12. In accordance with conventional practice, the artillery piece 12 includes a breech block 14 mounted to a hinged breech carrier 16 that swings to allow the breech to be opened and closed.

Figure 4:
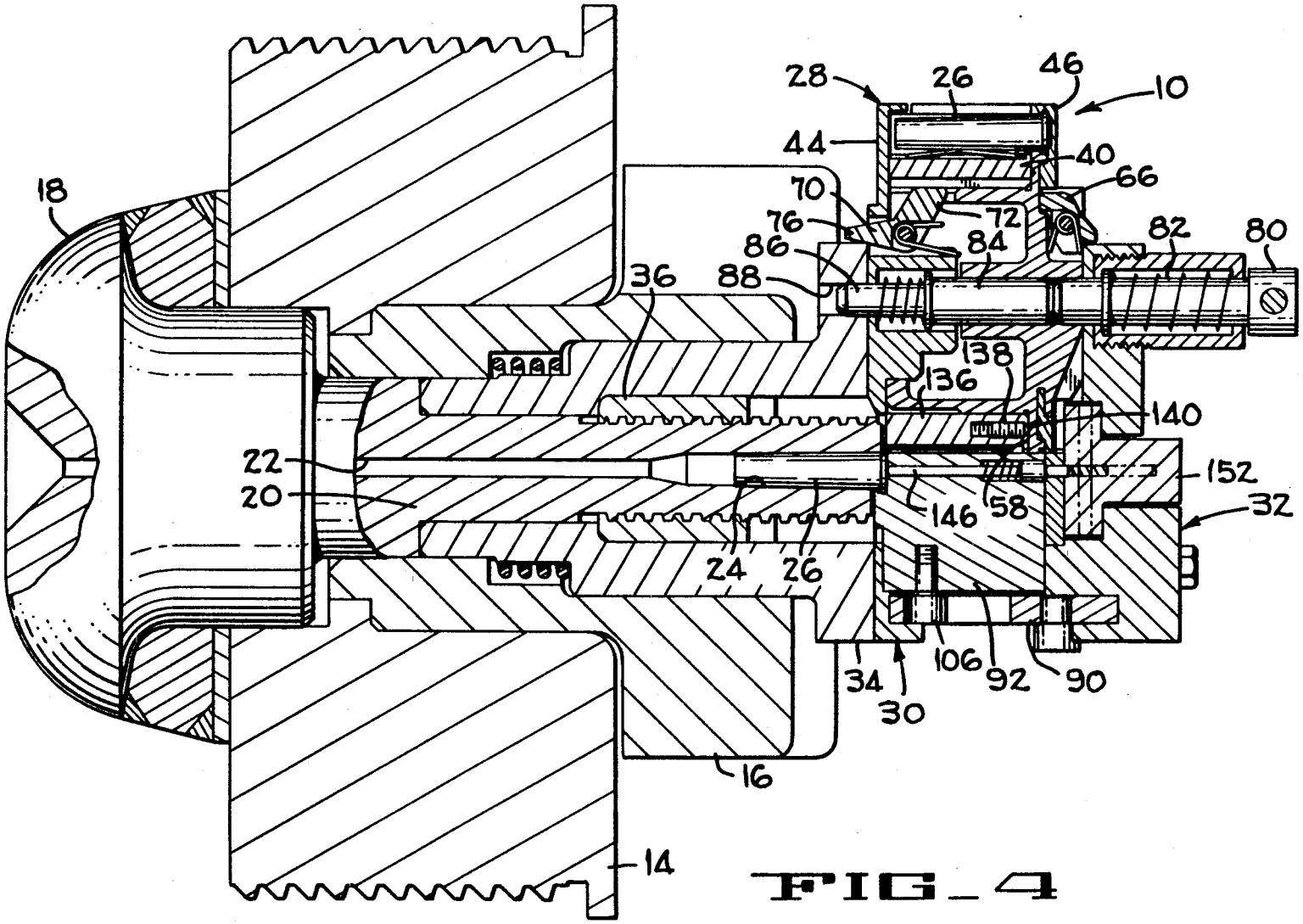
FIG. 4 is a sectional view of the automatic primer feed mechanism in place adjacent the breech block of an artillery piece.

As best seen in FIG. 4, the breech block 14 includes on its interior face an obturator 18 that is carried at one end of an obturator spindle 20 extending through the breech block 14. The obturator 18 and obturator spindle 20 include a central passageway 22 that terminates at one end in a chamber 24 for receiving therein a primer cartridge 26 of known construction. In use, a powder charge is placed in the gun barrel ahead of the breech block 14 which is then closed. Detonation of the primer cartridge 26 ignites the powder charge through the passageway 22 to fire the artillery piece.

The automatic primer feed mechanism 10 functions broadly to contain a plurality of primers 26, to automatically and individually insert unfired primers 26 into the chamber 24 and to automatically extract fired primers from the chamber. To this end, the automatic primer feed mechanism 10 generally includes a magazine assembly 28 for containing a plurality of primer cartridges 26, a mounting assembly 30 for mounting the magazine 28 to the breech end of the artillery piece 12, and an actuating mechanism 32 responsive to an operator input for individually feeding unfired primers 26 from the magazine 28 to the artillery piece 12 and for returning fired primers from the artillery piece to the magazine.

Preferably, the magazine 28 is detachable to permit the substitution of a magazine containing fresh primers for a magazine containing spent primers.

As best seen in FIG. 4, the automatic primer feed mechanism 10 is mounted to the artillery piece 12 by means of a base plate 34 that telescopingly engages the obturator spindle 20. An internally threaded nut 36, received within the hollow interior of the base plate 34, cooperates with external threads on the obturator spindle 20 to secure the baseplate 34 to the breech block 14 and breech carrier 16. The mounting assembly 30 is then bolted to the base plate.

Figure 6:
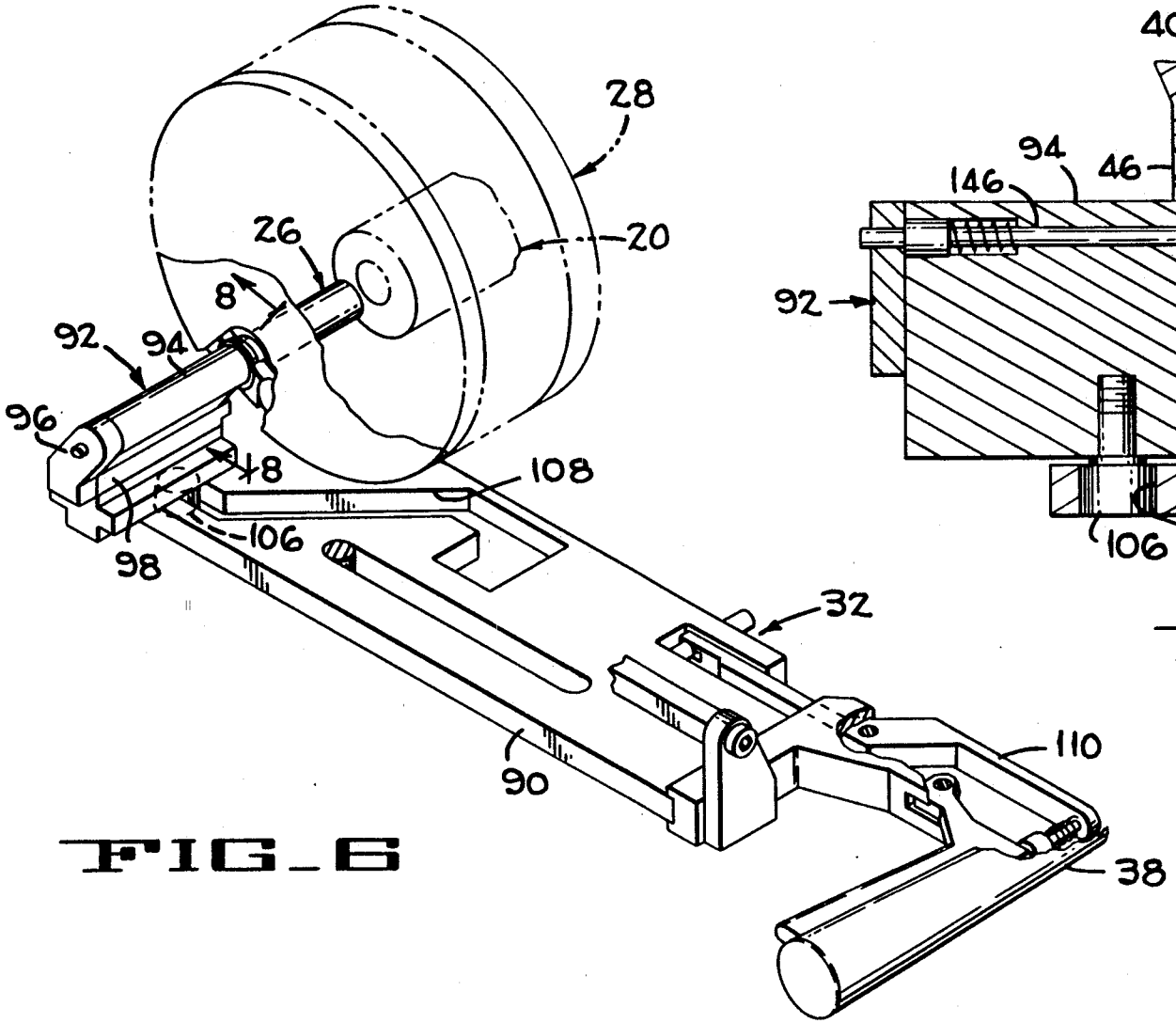
FIG. 6 is a diagrammatic view of an actuating mechanism for the automatic primer feed mechanism, useful in understanding the operation thereof.
Figure 7:
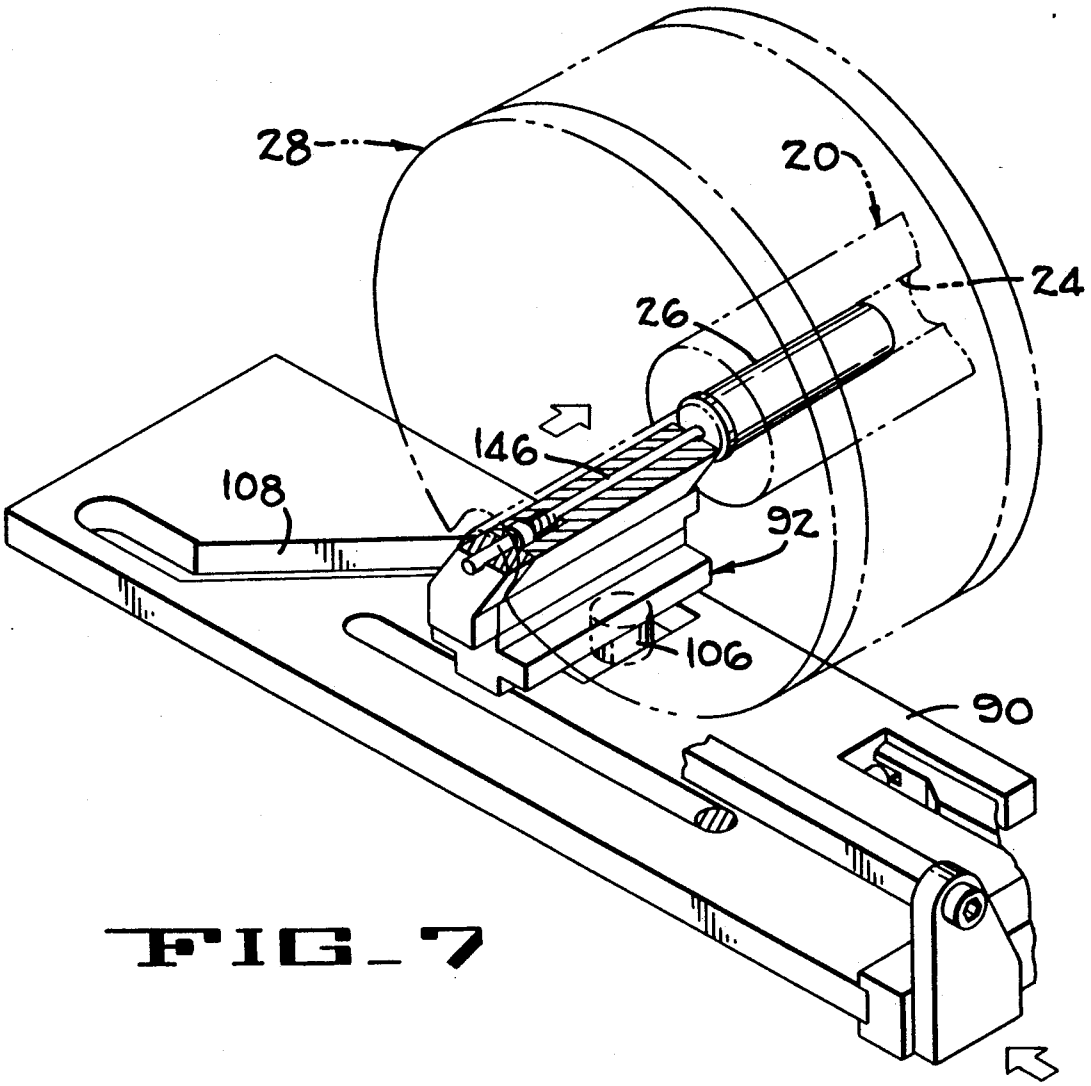
FIG. 7 is another diagrammatic view of an actuator mechanism for the automatic primer feed mechanism, useful in understanding the operation thereof.

In the illustrated embodiment, the actuating mechanism 32 for individually feeding the primers 26 includes a user control handle 38, and the operator input comprises lateral horizontal movement of the control handle 38 between a rearward position (FIG. 6) and a forward position (FIG. 7).

Movement of the handle 38 to the rearward position extracts a fired primer 26 from the chamber and returns it to the magazine 28. Movement of the control handle 35 from the rearward position to the forward position indexes the magazine 28 to bring a fresh primer 26 into alignment with the now empty chamber 24 and further results in the fresh primer 26 being loaded into the chamber 24.

Figure 5:
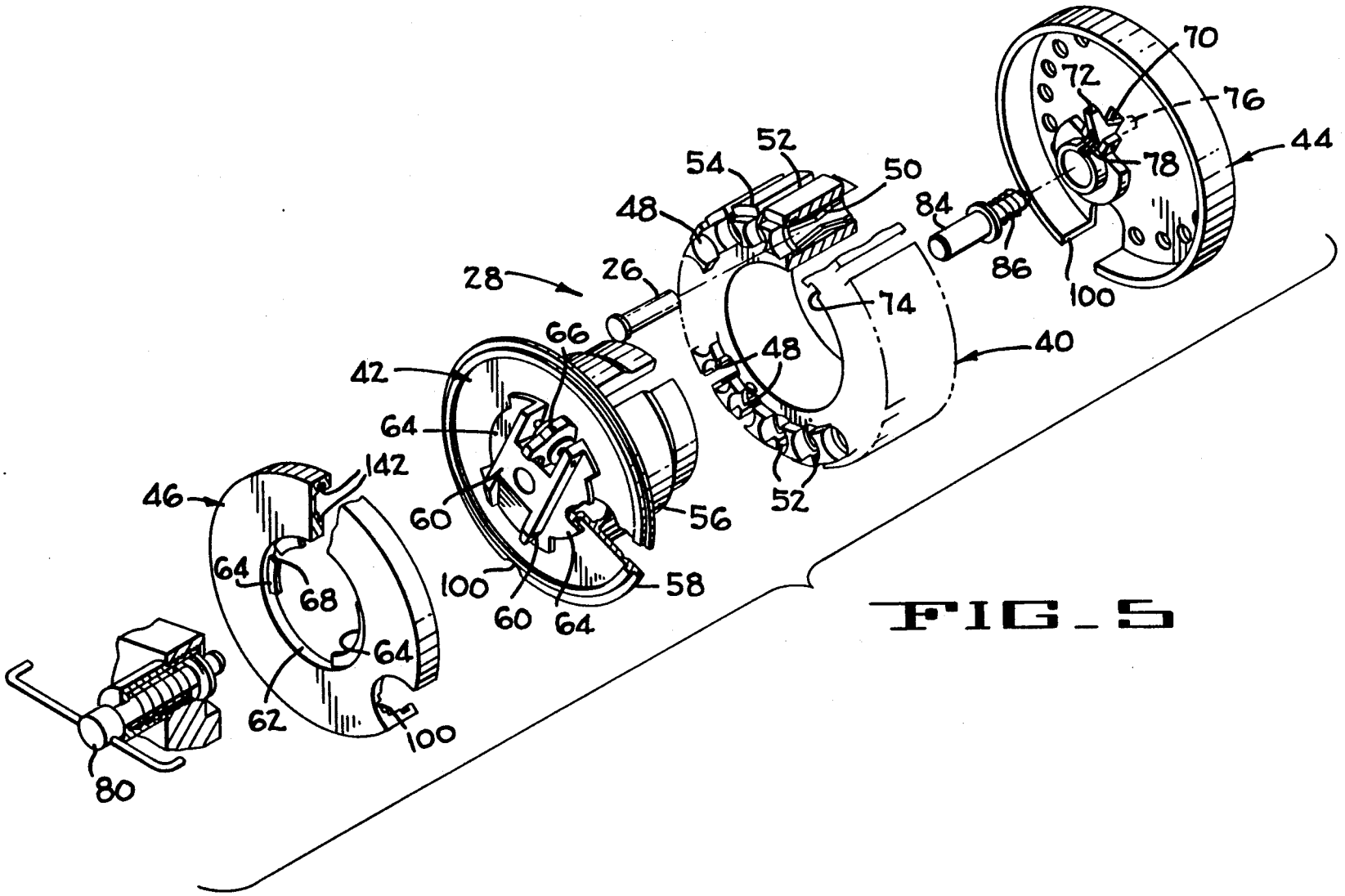
FIG. 5 is an exploded perspective view of a magazine assembly constructed in accordance with one aspect of the invention.

The construction of the magazine assembly 28 can best be understood by reference to FIG. 5. The magazine 28 comprises a generally cylindrical structure and includes a drum 40 mounted for rotation around a relatively stationary hub 42. The drum 40 and the hub 42 are positioned between a generally circular front plate 44 and an annular rim plate 46 that, together with the drum 40 and hub 42, form a unitary package.

The drum 40 consists of a generally disk-shaped structure having an open center and a plurality of axially extending, circumferentially disposed openings 48 for receiving individually therein the primers 26. A three legged leaf spring 50 mounted within each of the openings 48 centers each primer 26 in its respective opening 48. Each opening 48 further includes an axially extending slot 52 opening through the outer circumference 54 of the drum 40.

The hub 42 includes a central shaft portion 56 shaped to fit within the open center of the drum 40 to support the drum 40 for rotation around its axis. A circular flange portion 58 is formed at one end of the shaft portion 56 and includes, on its outer face, a pair of locating rails 60 for maintaining a fixed orientation of the magazine 28 when it is received in the mounting assembly 30. An additional pair of locating rails (not shown) are similarly formed on the outer face of the front plate 44.

The rim plate 46 includes a central aperture 62 that fits around the locating rails 60 of the hub 42. A bayonet-type locking system, including cooperating tabs 64 formed around the rim plate aperture 62 and the locating rails on the hub 42, is provided for detachably securing the rimplate 46 to the hub 42 to thereby lock the magazine assembly together. A spring biased tab 66, pivotally mounted between the locating rails 60, engages a slot 68 formed in one of the tabs 64 of the rim plate 46 and serves as a rim plate lock to prevent rotation of the rim plate 46 relative to the hub 42.

To prevent rotational movement of the drum 40 when the magazine assembly 28 is not mounted on the artillery piece 12, a drum lock mechanism is provided. The drum lock mechanism includes an angled lever 70 pivotally mounted adjacent the center of the endplate 44. One end 72 of the lever 70 extends inwardly toward the drum 40 and engages an axially extending slot 74 formed in the interior circumferential edge of the drum 40. The other end 76 of the lever extends through a slot formed in the endplate 44. A spring 78 biases the lever 70 in the counterclockwise direction as viewed in FIG. 5 so that the inner end 72 of the lever is driven upwardly into the slot 74 formed in the drum 40. This prevents rotation of the drum 40 relative to the end plate 44.

When the magazine assembly 28 is inserted into the mounting assembly 30 as shown in FIG. 4, the outer end 76 of the lever 70 engages the edge of the base plate 34 to pivot the lever 70 against the bias of the spring 78 and thereby withdraw the inner end 72 of the lever from the slot 74. This frees the drum 40 and permits it to rotate, but only when the magazine assembly 28 is mounted within the mounting assembly 30.

The mounting assembly 30 is dimensioned to receive and position the magazine assembly 28 so that its lower circumferential edge assembly is aligned with the chamber 24. The mounting assembly 30 includes a grooved receptacle that cooperates with the locating rails 60 formed on the magazine assembly hub 42 and magazine assembly end plate 44 to fix the rotational position of the magazine 28 relative to the mounting assembly 30. Preferably, the lower ends of the locating rails 60 are ramped, as illustrated, to facilitate insertion of the magazine assembly 28 into the mounting assembly 30. It will be appreciated that, although the magazine hub 42, rim plate 46 and end plate 44 are rotationally fixed relative to the mounting assembly 30, release of the magazine drum lock 72 nevertheless permits the drum 40 to rotate relative to the hub 42.

The magazine assembly 28 is detachably secured within the mounting assembly 30 by means of a user-actuable, spring biased, magazine release handle 80 included in the mounting assembly 30. The magazine release handle 80 includes an inwardly projecting plunger 82 that engages a spring-biased magazine retention pin 84 axially mounted at the center of the magazine assembly 28 and housed within a chamber formed by the magazine end plate 44 and magazine hub 42. When the magazine release handle 80 is pushed inwardly toward the magazine 28, the forward end 86 of the magazine retention pin 84 is forced into a recess 88 formed in the base plate 34 to thereby prevent removal of the magazine assembly 28. When the magazine release handle 80 is withdrawn, the spring of the magazine retention pin 84 causes the retention pin 84 to be withdrawn from the recess 88 thereby allowing the magazine assembly 28 to be removed.

Figure 8:
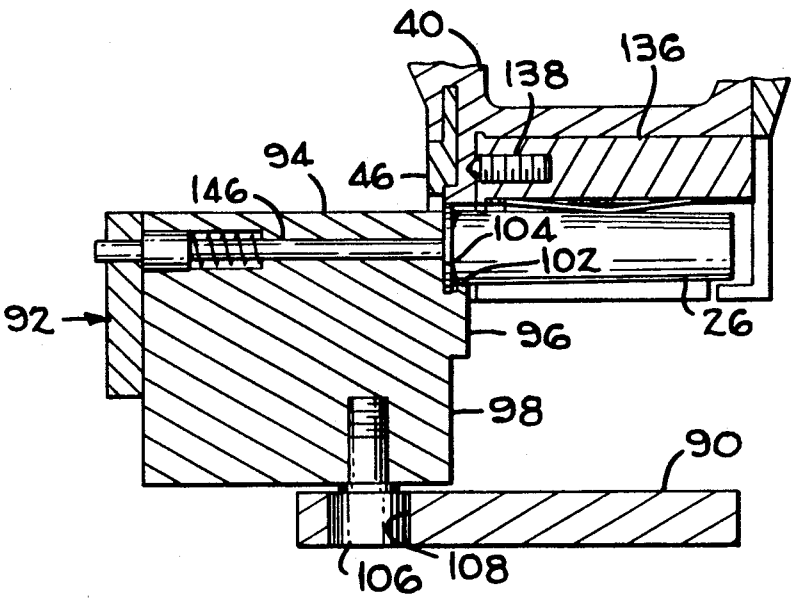
FIG. 8 is a cross sectional view taken along line 8—8 of FIG. 6.

Operation of the actuator mechanism 32 can best be understood by reference to FIGS. 6, 7 and 8. As illustrated, the actuator mechanism 32 includes the user-operable control handle 38 that is connected to an elongate cam plate 90. The actuator mechanism 32 further includes a bolt 92 that is operable to laterally displace individual ones of the primers 26 from the magazine 28 into the chamber 24. The bolt 92 also functions to extract fired primers 26 from the chamber 24 and return them to the magazine 28.

As illustrated, the bolt 92 includes an upper cylindrical portion 94 having the same general cross sectional dimension as the individual primers 26. The cylindrical portion 94, in turn, is formed at the end of a base portion 96 having a stem 98 dimensioned to extend through the axial slots 52 formed through the outer circumference of the magazine drum 40 (FIG. 5). This construction permits the bolt 92 to slide axially relative to the magazine assembly 28 and thereby individually displace the primers 26. As best seen in FIGS. 5, 6 and 7, the magazine end plate 44, hub 42 and rim plate 46 each include a half moon recess 100 to permit passage of the bolt 92.

As best seen in FIG. 8, an upwardly extending extractor lip 102 is formed along the lower edge of the bolt face ahead of arim 104 formed on the primer casing 26. The exactor lip 102 functions to engage the rim 104 and thereby extract the fired primer 26 from the chamber 24 as the bolt 92 is withdrawn.

The lower side of the bolt 92 is provided with a cam follower 106 that rides within an angled groove 108 formed in the cam plate 90. Movement of the control handle 30 from the rearward position shown in FIG. 6 to the forward position closes the bolt 92 thereby loading a primer 26 from the magazine 28 into the chamber 24. Movement of the handle 38 from the forward position to the rearward position opens the bolt 92 thereby extracting the fired primer 26 and returning it to the magazine 28.

Preferably, the control handle 38 includes a spring-biased release mechanism 110 that permits movement of the cam plate 90 only when the control handle 38 is grasped and squeezed by an operator's hand. This is to prevent inadvertent and unintentional movement of the control handle (control handle moves side to side) 38 from the forward position to the rearward position.

Figure 9:
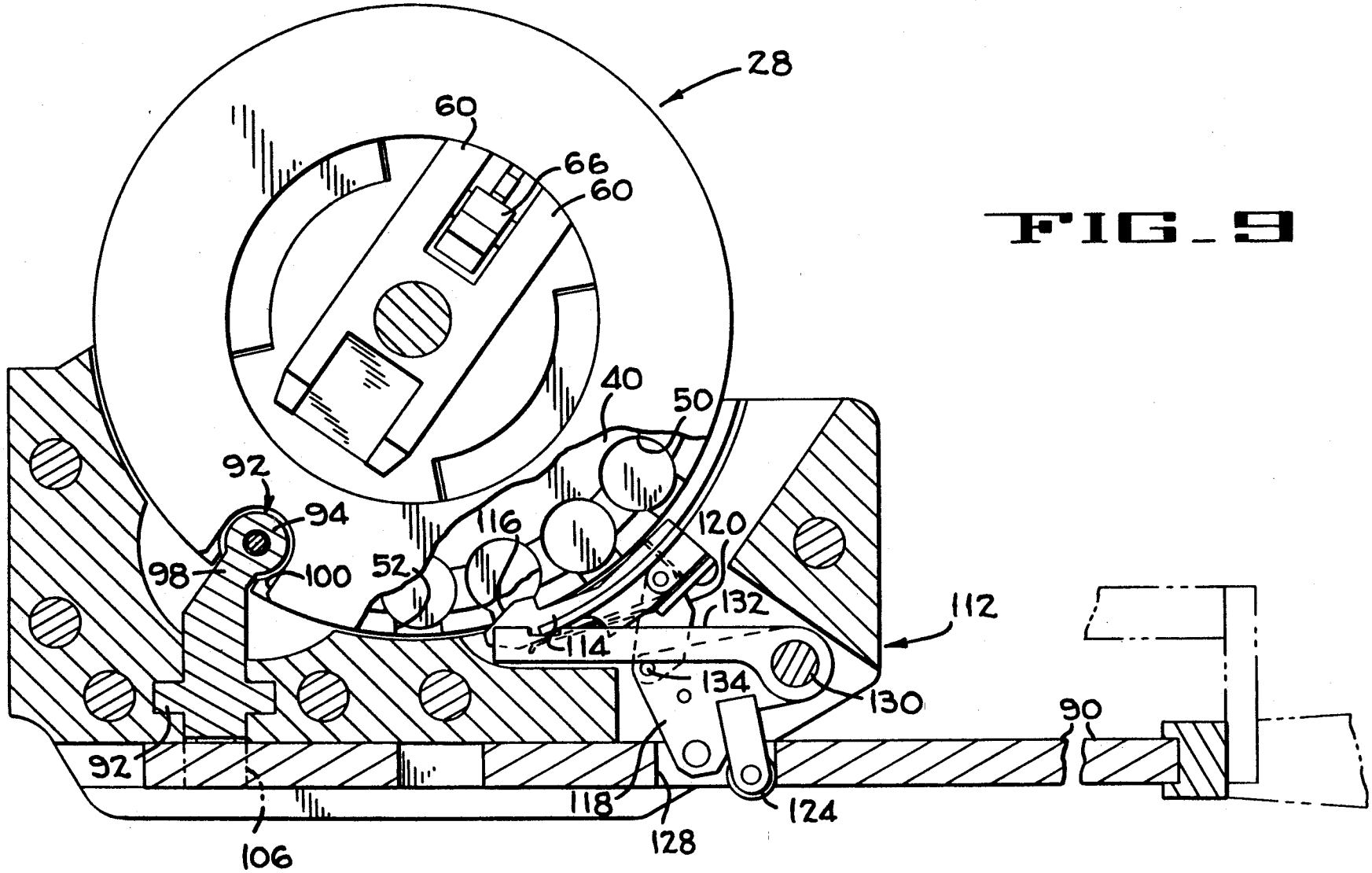
FIG. 9 is an enlarged end view, partially in section, of a drum indexing mechanism shown in a non-advancing condition.
Figure 10:
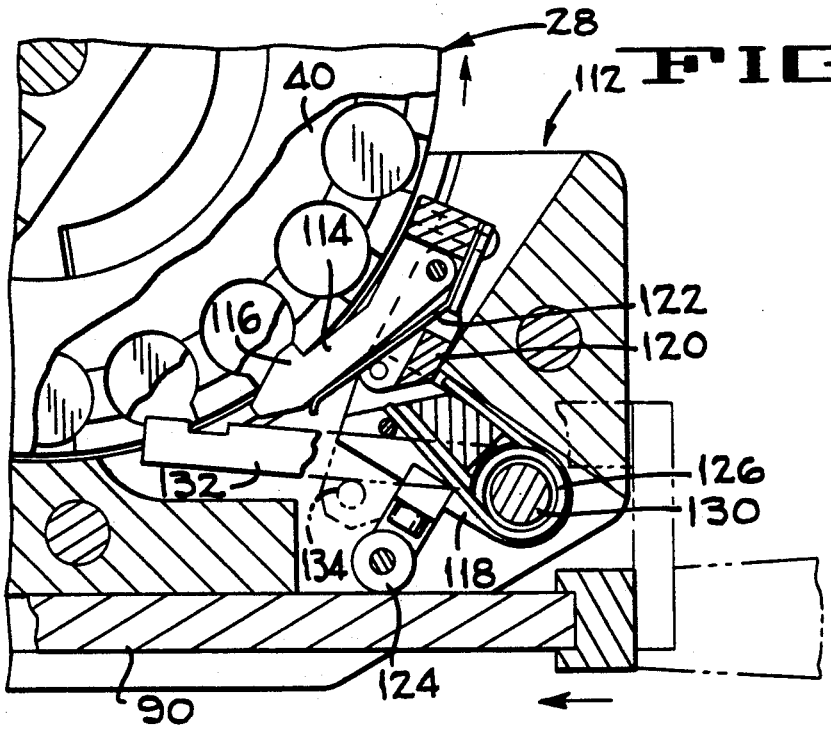
FIG. 10 is a fragmentary end view partially in section, of the drum indexing mechanism showing the mechanism in an advancing condition.
Figure 11:
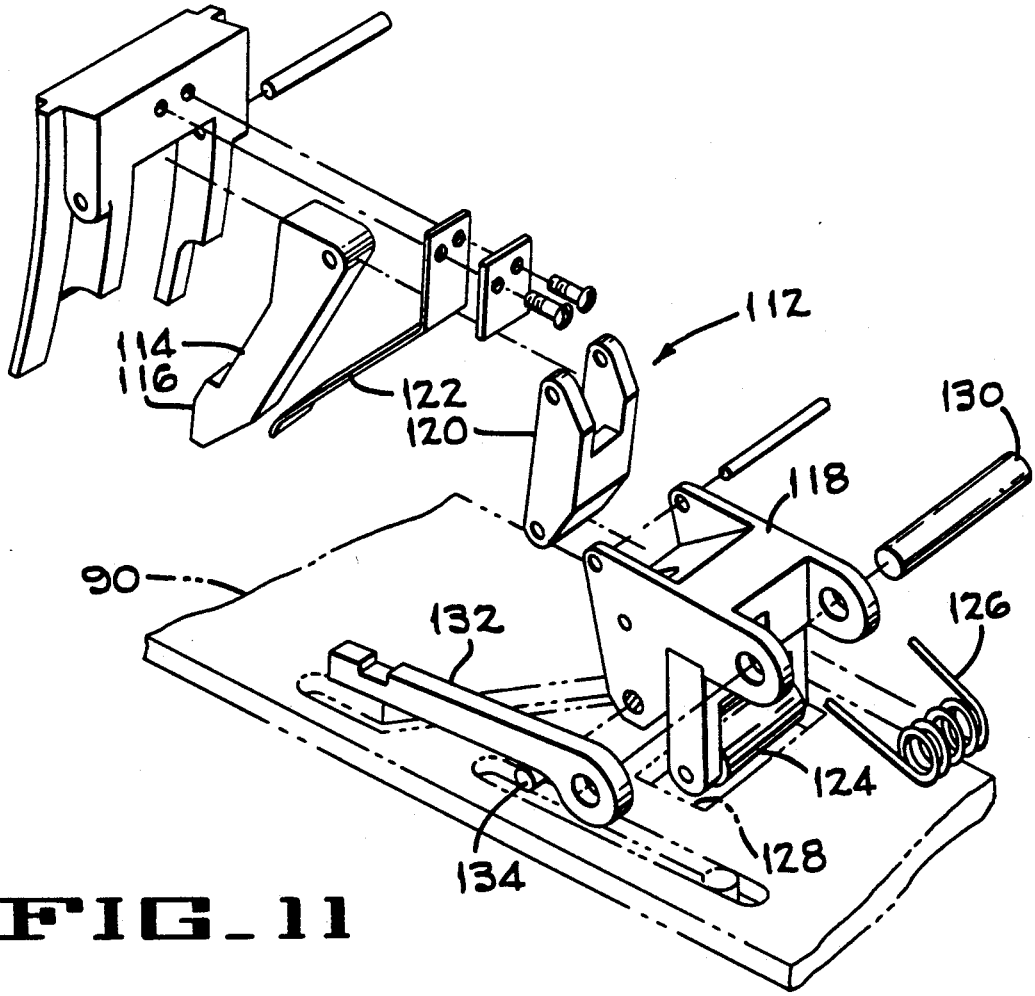
FIG. 11 is an exploded perspective view of the drum indexing mechanism shown in FIGS. 9 and 10.

The automatic primer fee mechanism 10 further includes an indexing mechanism 112 that functions to rotate the drum 40 upon each actuation of the control handle 38 and thereby bring a fresh primer 26 into alignment with the chamber 24. The indexing mechanism 112, which is best illustrated in FIGS. 9, 10 and 11, includes an indexing hook 114 having one end 116 adapted to engage the axial slots 52 formed in the rim of the drum 40. The hook 114 is coupled to an index lever 118 through a link arm 120 and is ordinarily biased toward the drum 40 by means of a leaf spring 122. The index lever 118 includes a downwardly extending index roller 124 that projects into the plane of the cam plate 90. A coil spring 126 biases the index lever 118 so that the index roller 124 is ordinarily urged below the top surface of the cam plate 90.

When the control handle 38 is in the rearward position as shown in FIG. 9, the index roller 124 projects through a slot 128 formed in the cam plate 90 thereby permitting the index lever 118, link arm 120 and index hook 114 to assume the positions shown in FIG. 9 Movement of the control handle 38 toward the forward position causes the index roller 124 to rise upwardly out of the slot 128 and onto the upper surface of the cam plate 90. This pivots the index lever 118 around its fulcrum 130 and causes the index hook 114 to move to the position shown in FIG. 10. As the hook 114 moves, it advances the drum 40 by the circumferential distance between adjacent primers 26. An additional lever 132 coupled to the index lever 118 is raised by a lift pin 134 projecting from the index lever 118 and engages the drum 40 to prevent overadvancement.

To further ensure that the drum 40 is indexed to the proper position and that the next primer 26 is properly aligned with the chamber 24, a spring loaded detent mechanism 136 is included within the magazine 28 as best seen in FIG. 4. The detent mechanism includes a spring-loaded detent ball 138 that engages one of a plurality of recesses 140 formed in the inside surface of the hub flange 58. The recesses 140 are carefully positioned so that, when the detent 136 is engaged, the adjacent primer is properly aligned with the chamber 24. The detent 136 also functions to enable the index hook 114 to return to the position shown in FIG. 9 without counterotating the drum 40.

To avoid possible sympathetic detonation of the unfired primers as the artillery piece 12 recoils the interior surface of the rim plate 46 includes a pair of interior grooves 142 that are best seen in FIG. 5. The interior grooves 142 engage the primer rims 104 (FIG. 8) to restrain the primers against lateral movement relative to the magazine 28. It is important that the dimensions of the grooves 142 closely match the thickness of the primer rims 104 to minimize lateral movement and the possibility of sympathetic primer detonation. The half moon cut out 100 formed in the rim plate 42 permits the primer rims to enter the grooves 142 as the primers are loaded into and removed from the magazine 28 one at a time.

Figure 12:
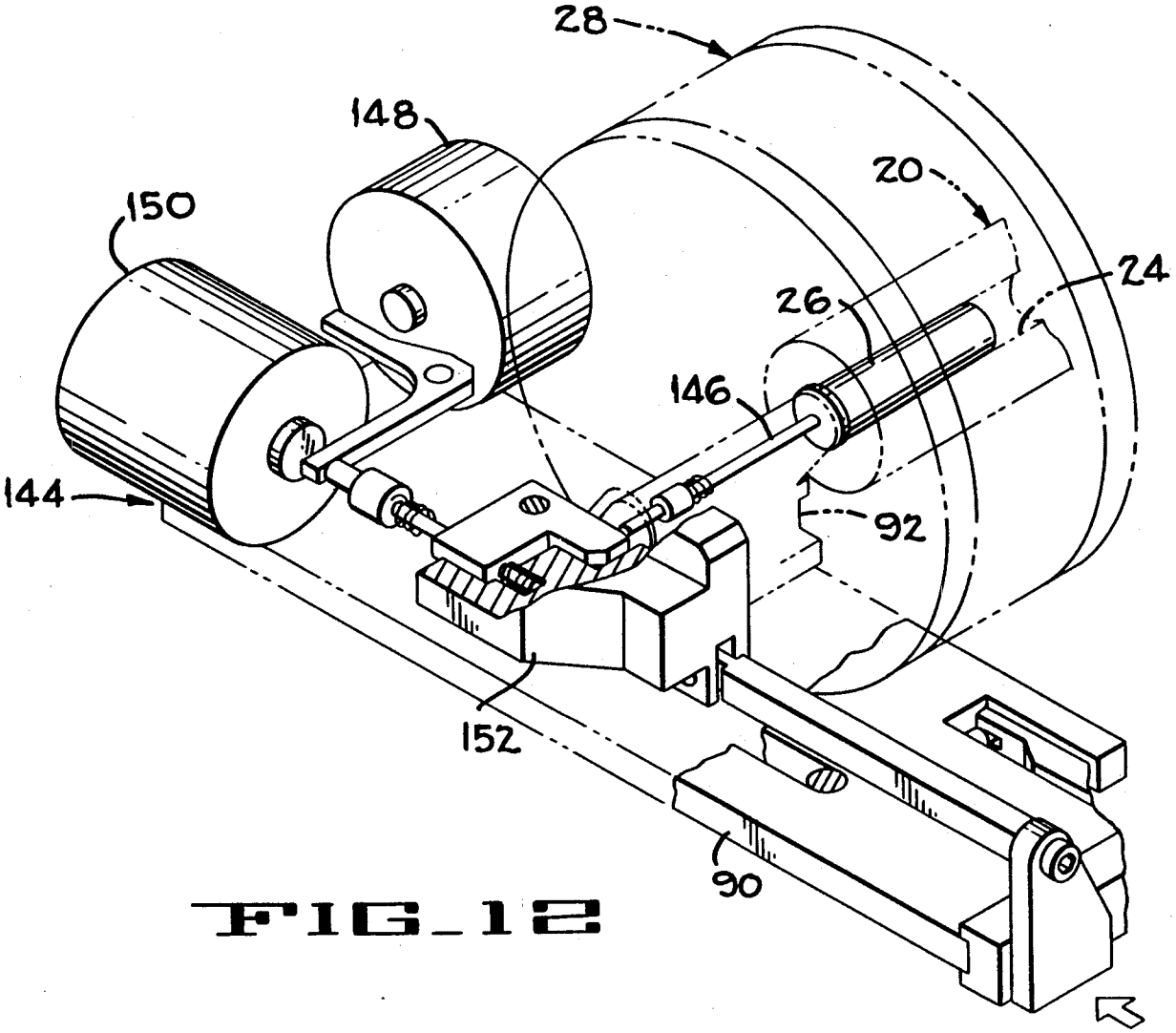
FIG. 12 is a perspective view of one embodiment of the primer feed mechanism showing the details of a firing control mechanism.

A fire control mechanism 144 for firing the artillery piece 12 is illustrated in FIG. 12. Each primer 26 is fired by means of a spring biased firing pin 146 that extends through the bolt 92. A blow to the exposed end of the firing pin 146 at the rear of the bolt 92 causes the primer 26 to fire. Such a blow can be provided by means of an electrically operated solenoid 148 or a mechanically operated, manually tripped firing mechanism 150 of known construction.

To transfer the impulse generated by either of these mechanisms 148, 150 to the firing pin 146, a firing lock 152 is included. The firing lock is carried on the cam plate 90 and hence moves in accordance with movement of the control handle 38. When the control handle 38 is in the forward position shown in FIG. 12, the firing lock 152 provides a mechanical linkage between the electrical solenoid 148 and/or the mechanical firing mechanism 150 and thereby enables either of these devices to transfer an impulse to the firing pin 146. The firing lock 152 provides primary support for the bolt during firing after the firing lock is slid behind the bolt as the bolt is cammed forward. When the control handle 38 is moved to the rearward position, the firing lock 152 is withdrawn removing the linkage between these devices 148, 150 and the firing pin 146. This helps guard against accidental discharge of the artillery piece 12.

The automatic primer feed mechanism of the present invention offers several advantages. For example, loading is simplified because the gun crew need only handle previously loaded magazine assemblies rather than individual primers. Furthermore, the fired primers are returned to the magazine for convenient handling. This avoids the potentially unsafe condition that can result when spent primer casings are ejected directly onto the artillery piece operating floor. Finally, the primer feed mechanism can be readily adapted for use with a variety of existing artillery pieces.

While a particular embodiment of the invention has been shown and described, it will be obvious of those skilled in the art that changes and modifications may be made without departing from the invention in its broader aspects, and, therefore, the aim in the appended claims is to cover all such changes and modifications as fall within the true spirit and scope of the invention.

What is claimed is:

1. A primer feed mechanism for an artillery piece with a firing chamber for receiving a primer comprising:

a magazine including a hub and a substantially cylindrical drum rotatably mounted about said hub, said drum including a plurality of openings, each of said openings adapted to receive a primer cartridge;

releasable mounting means for releasably mounting said hub to the breech end of the artillery piece;

actuating means, including bolt means, for individually displacing unfired primers from one of said openings into the firing chamber and for returning fired primers from the firing chamber into said one of said openings.

2. A primer feed mechanism as defined in claim 1 further comprising indexing means for rotating said drum around said hub in response to each operation of said actuating means.

3. A primer feed mechanism as defined in claim 1 wherein the artillery piece includes a breech block and wherein said mounting means mounts said magazine adjacent the breech block.

4. A primer feed mechanism as defined in claim 3 wherein the breech block is carried on a hinged breech carrier and wherein said mounting means are mountable on said breech carrier.

5. A primer feed mechanism as in claim 1, further comprising:

a firing pin for conveying an impulse from a firing mechanism to the primer to cause the primer to fire;

a plurality of firing mechanisms; and, a firing lock for conveying an impulse from any of said plurality of firing mechanisms to said firing pin.

6. A primer feed mechanism as in claim 5, in which one of said firing mechanisms is a solenoid firing mechanism.

7. A primer feed mechanism as in claim 6 in which one of said firing mechanisms is a mechanical firing mechanism.

* * * * *